United States Patent [19]

Goodrich

[11] Patent Number: 4,501,403

[45] Date of Patent: Feb. 26, 1985

[54] SHEET MUSIC TRAY FOR A GUITAR

[76] Inventor: Calvin O. Goodrich, P.O. Box 4879, Stockton, Calif. 95204

[21] Appl. No.: 460,276

[22] Filed: Jun. 13, 1983

[51] Int. Cl.[3] ..... G10G 7/00

[52] U.S. Cl. ..... 248/443; 248/460; 248/201; D6/419; 211/88

[58] Field of Search ..... 248/443, 298, 309 R, 248/300, 226.5, 201, 460, 441 R, 441 A–441 D; 108/46, 152; D6/18; 84/329, 180; 211/88

[56] References Cited

U.S. PATENT DOCUMENTS

| | | | |
|---|---|---|---|
| 174,377 | 3/1876 | Munson | 211/88 |
| D. 263,361 | 3/1982 | Johnson | D6/18 |
| 1,750,624 | 3/1930 | Buedingen | 248/300 |
| 1,925,523 | 9/1933 | Cuff | 211/88 |
| 2,540,928 | 2/1951 | Briggs | 248/443 |
| 2,546,757 | 3/1951 | Krarup | 248/443 |
| 4,300,743 | 11/1981 | Morris | 248/460 |

FOREIGN PATENT DOCUMENTS

| | | | |
|---|---|---|---|
| 99035 | 8/1898 | Fed. Rep. of Germany | 248/460 |
| 365758 | 12/1922 | Fed. Rep. of Germany | 248/443 |
| 231655 | 4/1925 | United Kingdom | 84/180 |

*Primary Examiner*—William H. Schultz
*Assistant Examiner*—Robert A. Olson
*Attorney, Agent, or Firm*—Leonard Bloom

[57] ABSTRACT

A removable sheet music retention device attached to a guitar provided with a first hook arm which engages the sound hole portion of the body of a guitar and a second hook arm which engages the forward portion of the neck of the guitar and a bar member therebetween having centrally disposed thereupon an upwardly and outwardly extending music tray with a horizontally disposed lip portion upon which any music or instruction materials may be placed so that a guitarist may move about freely while retaining his or her music or instruction materials in an advantageous position for visual and manual access.

4 Claims, 2 Drawing Figures

SHEET MUSIC TRAY FOR A GUITAR

BACKGROUND OF THE INVENTION

The instant invention relates generally to a sheet music retention device, and more specifically to a sheet music tray and mounting bar adapted to be removably attached to a guitar body so that one playing the guitar has a music tray associated therewith to conveniently display sheet music while allowing the guitar player or student to move about freely and retain the music within his field of vision.

The instant device is particularly well suited for use by a group of guitar students being taught by a single instructor. The students or the instructor may move about to gain better visual access to a particular strumming or fretting technique and the student's or teacher's music travels with him or her so that there need not necessarily be a stop in the flow of the instruction as the students move about to gain a better observation position. Similarly, when practicing alone, a student may attach the sheet music tray according to the instant disclosure to his or her guitar to facilitate observation of the sheet music or instruction material retained thereon. Additionally, the device according to the instant application can be used by a skilled or professional guitar player during a performance to provide easy and efficient visual and manual access to the sheet music associated with the performance.

The prior art of which applicant is aware that may be germane to the patent process is as follows: T. Q. Ney, U.S. Pat. No. 2,807,183.

The patent to Ney is of interest since it provides a device for teaching music having an angulated music tray associated therewith to retain sheet music or teaching materials thereon. The instant disclosure is easily distingished in that the sheet music tray is associated with a distinct mounting member which allows same to be removably attached to a guitar body providing a guitar musician with a portable sheet music tray upon which to carry any required sheet music or other materials.

SUMMARY AND OBJECTS OF THE INVENTION

Accordingly, it is a primary object of the present invention to provide a novel sheet music retention device for guitar which clamps onto the guitar body in an unobtrusive manner so that sheet music or other teaching materials can be placed and retained thereupon in such a position that the guitar player is provided with easy and efficient visual and manual access to the sheet music and or the instruction material.

It is another object of the present invention to provide a novel sheet music retention device for a guitar having a removable sheet music tray so that the device can be disassembled for easy storage and reassembled very quickly. The music tray being engaged upon a horizontally disposed structural member so that the tray extends upwardly and outwardly from the guitar body in such a position that any sheet music or materials retained thereupon are placed in such a relationship to the guitar player that the materials are easily observed and can be quickly manipulated when pages must be turned or the like.

It is yet another object of the present invention to provide a novel sheet music retention device for a guitar which facilitates the instruction process of learning to play a guitar by providing each student with his or her portable music tray removably attached to the guitar body so that the student may move around freely to observe various manual postures being taught by a guitar instructor and attempt to emulate same without having to be disassociated from the sheet music or learning instruction materials.

It is a further object of the present invention to provide a novel sheet music retention device for a guitar which has a front clamping arm which attaches to the forward part of the neck of the guitar and a rear clamping arm which is attached to the body of the guitar in the vicinity of the sound hole so that an integrally disposed music tray can be easily associated thereto. The clamping arms simply hook to the guitar body at a central and a forward portion thereof without interfering with the strings or the manipulation of the strings.

It is a still further object of the present invention to provide a novel sheet music retention device for a guitar which is simple, easy to manufacture, and lends itself well to mass production techiques.

The aforementioned objects are accomplished by the provision of a horizontally disposed mounting bar having upwardly extending therefrom on one end a clamp bar which engages the guitar body through the sound hole and on an opposed end thereof a similar clamping bar which removably engages the forward portion of the guitar neck, the mounting bar having in a central portion thereof a stepped down area adapted to receive therein a channel associated with a music tray extending upwardly and forwardly therefrom, the music tray having on a lower portion thereof a horizontally disposed lip upon which sheet music or instruction materials may rest. The positioning of the sheet music tray places the sheet music or instruction materials in an advantageous position for easy observation and manual access.

These and other objects will become apparent when viewed in light of the following specifications taken in conjunction with the appended drawing figures.

BRIEF DESCRIPTION OF THE DRAWINGS

FIG. 1 is an isometric view showing the device according to the instant application as it would appear attached to a guitar.

DESCRIPTION OF THE PREFERRED EMBODIMENT

Figure 2:
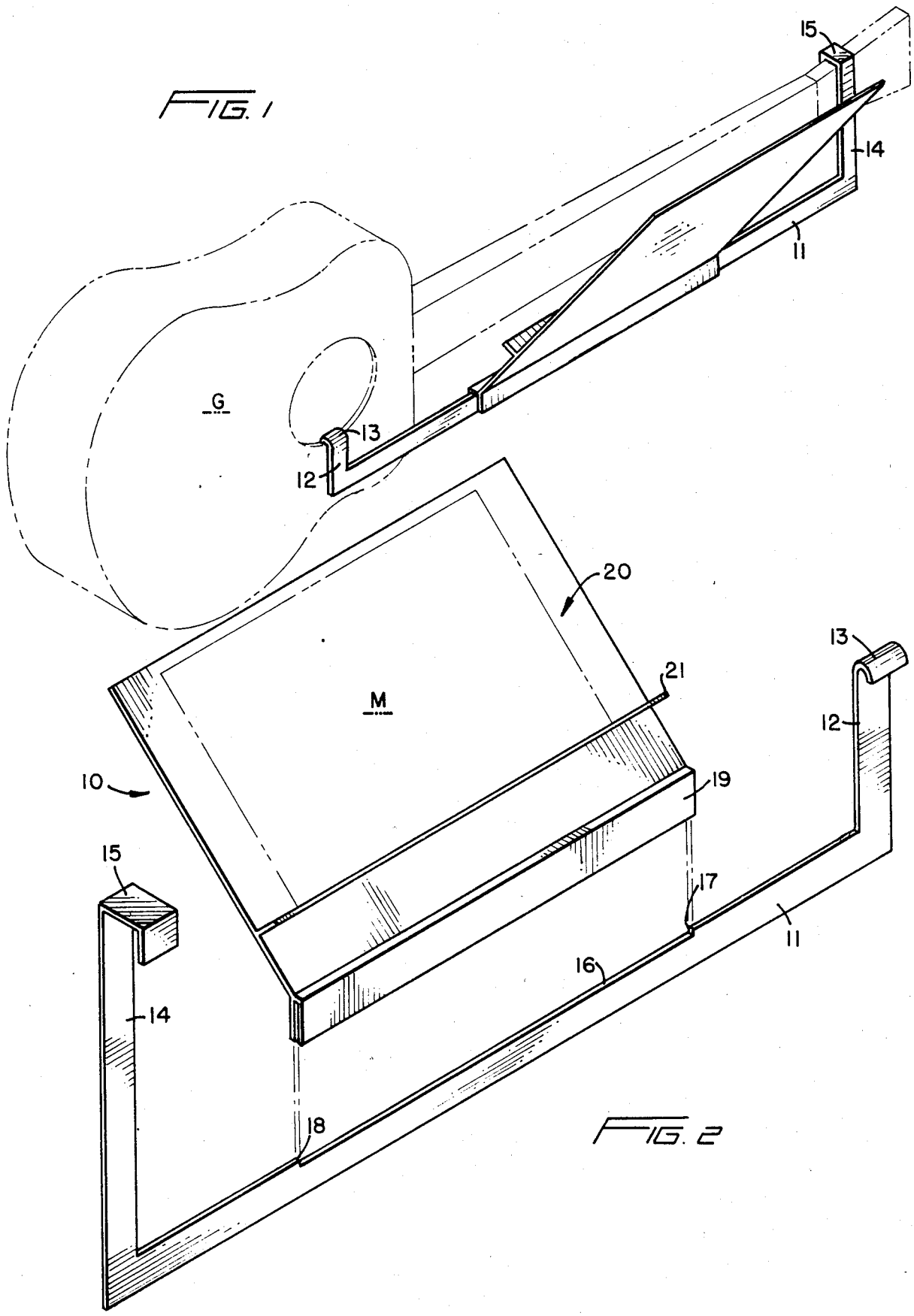
FIG. 2 is an isometric view of the device itself showing the music tray in a removed position.

Referring now to the drawings in detail wherein like reference numerals represent like parts throughout the several figures, reference numeral 10 refers generally to the device according to the instant application. Referring now to FIG. 1, the device has a horizontally disposed flat bar member 11 having on one end an upwardly extending first hook arm 12 with a looped end 13 designed to removably engage the guitar body G by extending through the sound hole and there after downwardly inside the guitar body so that the hook arm may be clamped onto the guitar body by simply sliding same onto the body through the sound hole.

The flat bar member 11 has on an opposed end thereof an upwardly extending second hook arm 14 having on an upward end thereof an essentially u-shaped portion 15 designed to removably engage the forward portion N of the guitar neck by slidably clamping over the guitar neck and being retained thereupon.

The flat bar member 11 and the associated clamping arms 12 and 14 may be constructed from aluminum, plastic or any other material which provides strength, durability, and light weight. It should be noted further that the looped end 13 and the U-shaped portion 15 of the clamping arms 12 and 14 may receive on an inner suface thereof abrasion prevention materials such as felt, rubber, or the like to prevent the device from marring the surfaces of the guitar upon which it rests.

Referring now to FIG. 2, the flat bar 11 has on an upper surface of a central portion thereof a stepped down area 16 defined by a first step 17 and a second step 18. The stepped down area 16 is designed to removably receive thereupon an elongate channel portion 19 associated with the music tray 20. The elongate channel 19 slips over the flat bar 11 at the stepped down portion 16 being removably retained thereupon and prevented from horizontal translation by steps 17 and 18. The music tray 20 is attached to an upper outer surface of the channel 19 and extends upwardly and outwardly therefrom angled away from the guitar body and towards the guitarist's head so that the sheet music M retained thereupon is readily displayed to the guitar player. The music tray 20 has on a lower inner surface thereof a horizontally disposed retention lip 21 upon which the music M rests. Thus the music may be easily accessed to turn pages or adjust the position so that the guitar player may accomplish same without having to reach a great distance as might be the case with a remote sheet music tray associated with a stand.

In use and operation the flat bar 11 with its associated hook arms 12 and 14 is attached to the guitar body and neck by slipping the looped portion 13 into the sound hole of the guitar and the u-shaped portion 15 over the end of the neck, thereafter slipping the music tray onto the flat 11 at the stepped down portion 16. Now the device may be used by placing the music M or other instructional materials on the music tray 20 so that the materials rest upon the lip portion 21 thus being easily visually and manually accessed by the guitar player. This provides the guitar player with the ability to move about freely while retaining his or her music or instruction materials in a position to be easily observed so that he or she may move to a better observational position to observe the hands of an instructor without having to stop playing to accomplish the observation. Similarly, the instructor may move freely amongst his or her students to observe as he or she furthers the instruction process.

It should be noted that numerous structural modifications and changes may be resorted to without departing from the spirit of the invention.

What is claimed is:

1. A sheet music retention device adapted to be removably attached to a guitar, wherein the guitar has a body provided with a sound hole therein, and wherein the guitar further has a neck provided with a forward portion, comprising in combination:

a first hook arm adapted to removably engage the sound hole in the guitar body, a second hook arm adapted to removably engage the forward portion of the guitar neck, a bar member connected between and supporting said first and second hook arms, said bar member having an upper central portion thereof, an elongate channel adapted to be removably received on the upper central portion of the bar member, a music tray extending upwardly and outwardly from the channel, and a horizontally disposed retention lip on the music tray, whereby sheet music or instructional materials may be placed on the tray, and whereby a guitar player may move about freely while retaining the sheet music or instruction materials on the tray.

2. The device of claim 1 wherein said bar member is flat, and wherein said music tray is advantageously positioned upon and prevented from horizontal translation across said flat bar member by steps defining a stepped down portion of said flat bar member which engages said channel, whereby said music tray is securely mounted upon said flat bar member.

3. The device of claim 1 wherein said first and second hook arms have on an inner surface thereof cushioning means to prevent said arms from marring the finished surfaces of a guitar.

4. The device of claim 1 wherein said retention lip is mormal to an upper surface of said music tray and extends horizontally the extent of said music tray, whereby said sheet music or instructional materials may be spread across the extent of said music tray and retained thereupon.

* * * * *